US008206085B2

(12) United States Patent
Ammann

(10) Patent No.: US 8,206,085 B2
(45) Date of Patent: Jun. 26, 2012

(54) TURBINE ENGINE SHROUD RING

(75) Inventor: Luke J. Ammann, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 617 days.

(21) Appl. No.: 12/402,847

(22) Filed: Mar. 12, 2009

(65) Prior Publication Data

US 2010/0232940 A1 Sep. 16, 2010

(51) Int. Cl.
*F04D 29/54* (2006.01)

(52) U.S. Cl. ..... 415/136; 415/138; 415/139; 415/173.1

(58) Field of Classification Search ..... 415/136, 415/138, 139, 173.1–173.3
See application file for complete search history.

(56) References Cited

U.S. PATENT DOCUMENTS 4,988,266 A * 1/1991 Nakamura et al. ..... 415/173.1
5,167,487 A 12/1992 Rock
5,181,827 A 1/1993 Pellow et al.
6,722,851 B1 4/2004 Brittingham et al.

* cited by examiner

*Primary Examiner* — Victor A Mandala
*Assistant Examiner* — Krista Soderholm
(74) *Attorney, Agent, or Firm* — Fletcher Yoder P.C.

(57) ABSTRACT

In one embodiment, a system includes a turbine engine that includes a rotor including multiple blades. The turbine engine also includes a shroud disposed about the blades. The shroud includes multiple segments engaged with one another via mating teeth. The mating teeth are oriented in an axial direction along a longitudinal axis of the turbine engine.

20 Claims, 6 Drawing Sheets

TURBINE ENGINE SHROUD RING

BACKGROUND OF THE INVENTION

The subject matter disclosed herein relates to a gas turbine engine and, more specifically, to turbine engine shrouds, shroud rings and shroud hangers.

A turbine engine includes a turbine having multiple blades attached to a central rotor. A hot pressurized fluid, such as steam or combustion gases, drives these blades to rotate, which in turn rotate the central rotor to drive one or more loads. For example, the loads may include an air compressor of a gas turbine engine, an electrical generator, or both. The performance of the turbine engine is at least partially based on the energy transfer from the hot pressurized fluid to the blades. Thus, a clearance between these blades and a shroud can significantly affect the performance. A greater clearance generally results in a greater leakage and thus reduced performance, whereas a lesser clearance generally results in a lesser leakage and thus increased performance. Unfortunately, a lesser clearance can potentially result in a rub condition between the blades and the shroud. For example, the turbine components may expand, contract, or generally deform with temperature changes, which may in turn lead to variations in the symmetry, alignment, and clearance of the shroud relative to the blades. These variations in symmetry, alignment, and clearance can reduce performance and increase wear on the turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine engine that includes a rotor including multiple blades. The turbine engine also includes a shroud disposed about the blades. The shroud includes multiple segments engaged with one another via mating teeth. The mating teeth are oriented in an axial direction along a longitudinal axis of the turbine engine.

In a second embodiment, a system includes a turbine shroud including multiple segments disposed in a circumferential arrangement and configured to surround multiple turbine blades. The turbine shroud includes a first segment including a first set of teeth disposed on a first circumferential side and a second set of teeth disposed on a second circumferential side. The first and second sets of teeth extend in an axial direction relative to an axis of the turbine shroud. The turbine shroud also includes a second segment including a third set of teeth disposed on a third circumferential side and a fourth set of teeth disposed on a fourth circumferential side. The third and fourth sets of teeth extend in the axial direction relative to the axis of the turbine shroud. The first and second segments couple together at the second and third sets of teeth, and the second and third sets of teeth support the first and second segments in a radial direction relative to the axis of the turbine shroud In a third embodiment, a system includes a turbine casing and a turbine shroud including multiple shroud segments configured to extend about multiple turbine blades. The system also includes a pin and slot guide disposed between the turbine casing and the shroud segments. The pin and slot guide is configured to enable radial movement of the shroud segments relative to a rotational axis of a turbine engine.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
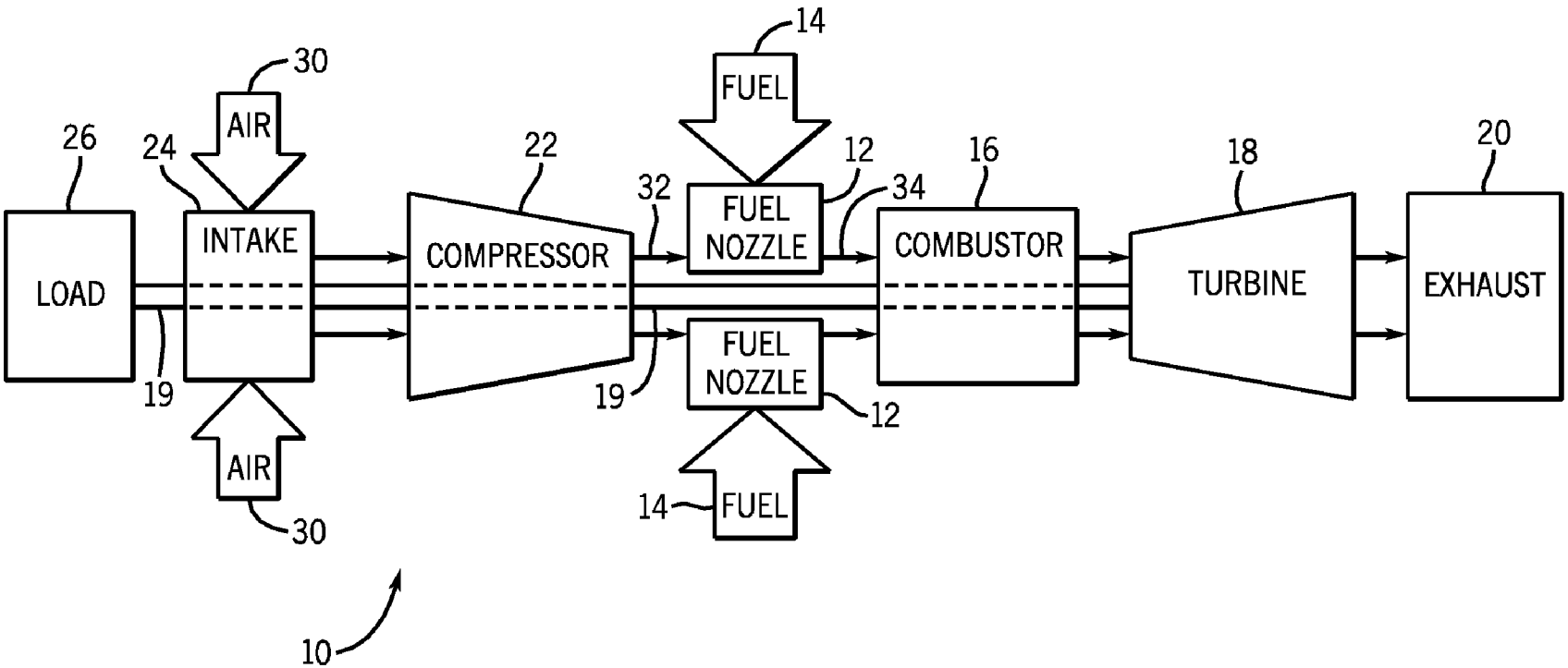
FIG. 1 is a block diagram of a turbine system having a turbine that includes a shroud ring configured to maintain a substantially circular shape throughout the entire operating temperature range of the turbine system in accordance with certain embodiments of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure may increase turbine system efficiency by reducing the quantity of hot pressurized fluids (e.g., steam or combustion gases) that bypass turbine blades. Specifically, a turbine shroud may be disposed about the turbine blades to minimize the distance between the turbine blades and an outer turbine casing. In certain embodiments, the turbine shroud includes multiple segments that interlock to form a continuous annular ring. In this configuration, the shroud may maintain a substantially circular shape throughout the operating temperature range of the turbine system. In certain embodiments, the shroud segments engage one another via mating teeth. These mating teeth may be oriented in an axial direction along a longitudinal axis of the turbine engine and serve to support the segments in a radial direction. These mating teeth may be configured to engage one another at different radial positions in response to thermal expansion and contraction of the segments. In this manner, the shroud may maintain its substantially circular shape despite variations in turbine system temperature. Furthermore, the shroud segments may be mounted to the turbine casing via a pin and groove arrangement that enables radial movement of each shroud segment with respect to the casing. Therefore, as turbine temperature increases, expansion of the shroud segments may cause the segments to move radially outward. Similarly, hot turbine conditions may induce turbine blades to elongate.

The combination of elongating turbine blades and expanding shroud segments may result in a substantially constant separation distance, i.e., clearance, between the turbine blades and the shroud throughout the operating temperature range of the turbine system. Maintaining a substantially constant separation distance enables the turbine blades to be closer to the shroud, while reducing the possibility of rubbing between the blades and the shroud. The closer separation distance minimizes fluid leakage or bypass of the hot pressurized fluid (e.g., steam or combustion gases), thereby enhancing energy transfer from the hot pressurized fluid to the rotor. In certain embodiments, each shroud segment may include one or more cover segments that serve as a thermal barrier to protect the shroud segments from the hot pressurized fluid. In the following discussion, embodiments of the invention will be discussed in context of a gas turbine engine, yet the embodiments are equally applicable to steam turbine engines and other rotary machines.

Turning now to the drawings and referring first to FIG. 1, a block diagram of an embodiment of a gas turbine system 10 is illustrated. The diagram includes fuel nozzle 12, fuel supply 14, and combustor 16. As depicted, fuel supply 14 routes a liquid fuel and/or gas fuel, such as natural gas, to the turbine system 10 through fuel nozzle 12 into combustor 16. As discussed below, the fuel nozzle 12 is configured to inject and mix the fuel with compressed air. The combustor 16 ignites and combusts the fuel-air mixture, and then passes hot pressurized exhaust gas into a turbine 18. The exhaust gas passes through turbine blades in the turbine 18, thereby driving the turbine 18 to rotate. As discussed in detail below, the turbine 18 includes a shroud ring configured to direct exhaust gas through the turbine blades, thereby increasing turbine efficiency. The shroud ring may include multiple segments that interlock via mating teeth to ensure that the shroud ring maintains a substantially circular shape and substantially constant separation distance (i.e., clearance) from the turbine blades throughout the entire operating temperature range of turbine system 10. Coupling between blades in turbine 18 and shaft 19 will cause the rotation of shaft 19, which is also coupled to several components throughout the turbine system 10, as illustrated. Eventually, the exhaust of the combustion process may exit the turbine system 10 via exhaust outlet 20.

In an embodiment of turbine system 10, compressor blades are included as components of compressor 22. Blades within compressor 22 may be coupled to shaft 19, and will rotate as shaft 19 is driven to rotate by turbine 18. Compressor 22 may intake air to turbine system 10 via air intake 24. Further, shaft 19 may be coupled to load 26, which may be powered via rotation of shaft 19. As appreciated, load 26 may be any suitable device that may generate power via the rotational output of turbine system 10, such as a power generation plant or an external mechanical load. For example, load 26 may include an electrical generator, a propeller of an airplane, and so forth. Air intake 24 draws air 30 into turbine system 10 via a suitable mechanism, such as a cold air intake. The air 30 then flows through blades of the compressor 22, which provides compressed air 32 to the combustor 16. In particular, the fuel nozzle 12 may inject the compressed air 32 and fuel 14, as a fuel-air mixture 34, into the combustor 16. The fuel nozzle 12 may include a flow conditioner, a swirler, and other features configured to produce a suitable fuel-air mixture 34 for combustion, e.g., a combustion that causes the fuel to more completely burn, so as not to waste fuel or cause excess emissions. An embodiment of turbine system 10 includes certain structures and components (e.g., a segmented shroud ring with axially-oriented teeth between circumferentially adjacent segments) within turbine 18 to increase turbine efficiency by directing additional exhaust gas through the turbine blades.

Figure 2:
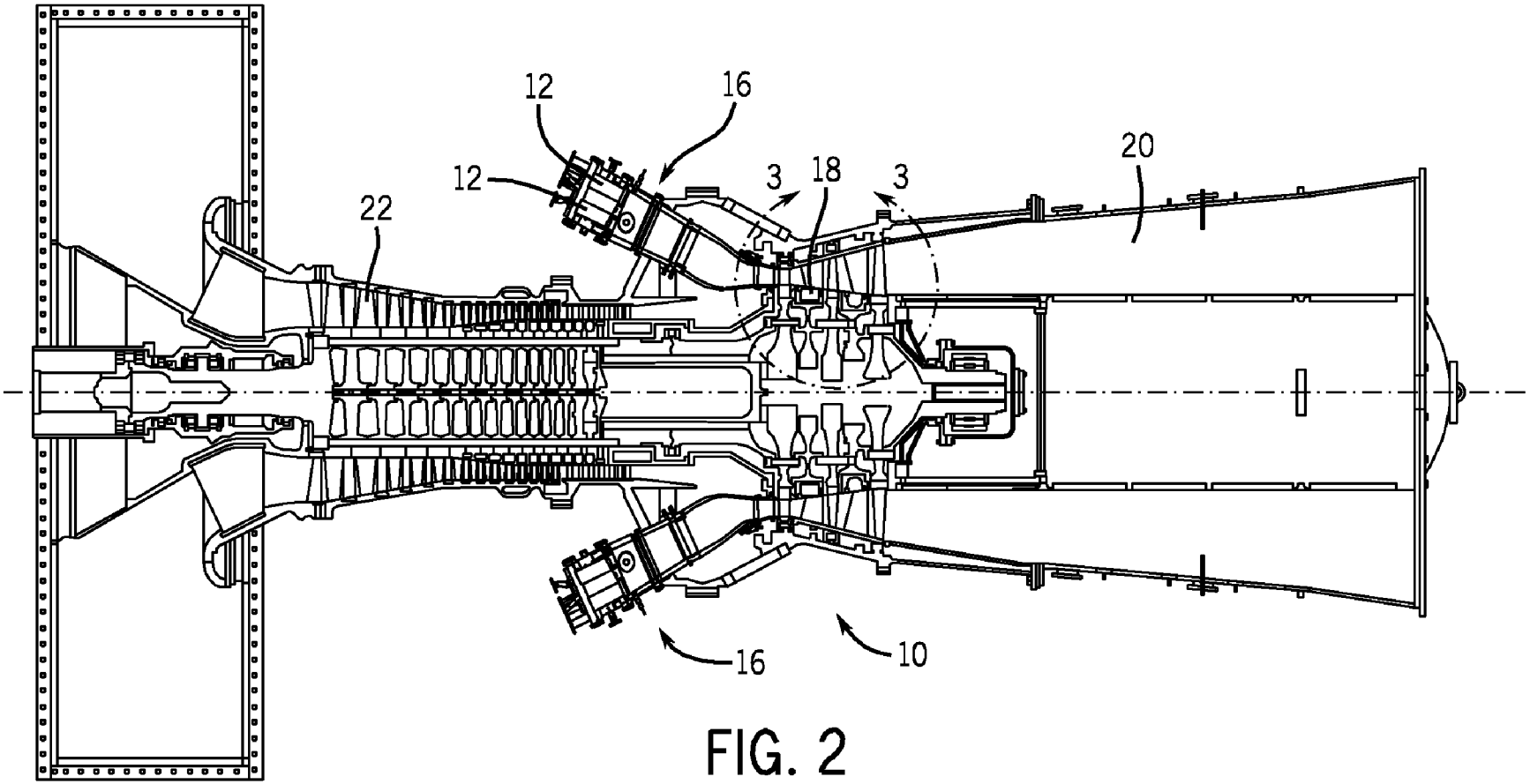
FIG. 2 is a cutaway side view of the turbine system, as shown in FIG. 1, in accordance with certain embodiments of the present technique.

FIG. 2 is a cutaway side view of an embodiment of turbine system 10. As depicted, the embodiment includes compressor 22, which is coupled to an annular array of combustors 16, e.g., six, eight, ten, or twelve combustors 16. Each combustor 16 includes at least one fuel nozzle 12 (e.g., 1, 2, 3, 4, 5, 6, 7, 8, 9, 10, or more), which feeds an air-fuel mixture to a combustion zone located within each combustor 16. Combustion of the air-fuel mixture within combustors 16 will cause vanes or blades within turbine 18 to rotate as exhaust gas passes toward exhaust outlet 20. As discussed in detail below, certain embodiments of turbine 18 include a variety of unique features (e.g., a segmented shroud ring with axially-oriented teeth between circumferentially adjacent segments) to increase combustion gas flow through the turbine blades, thereby increasing turbine efficiency.

Figure 3:
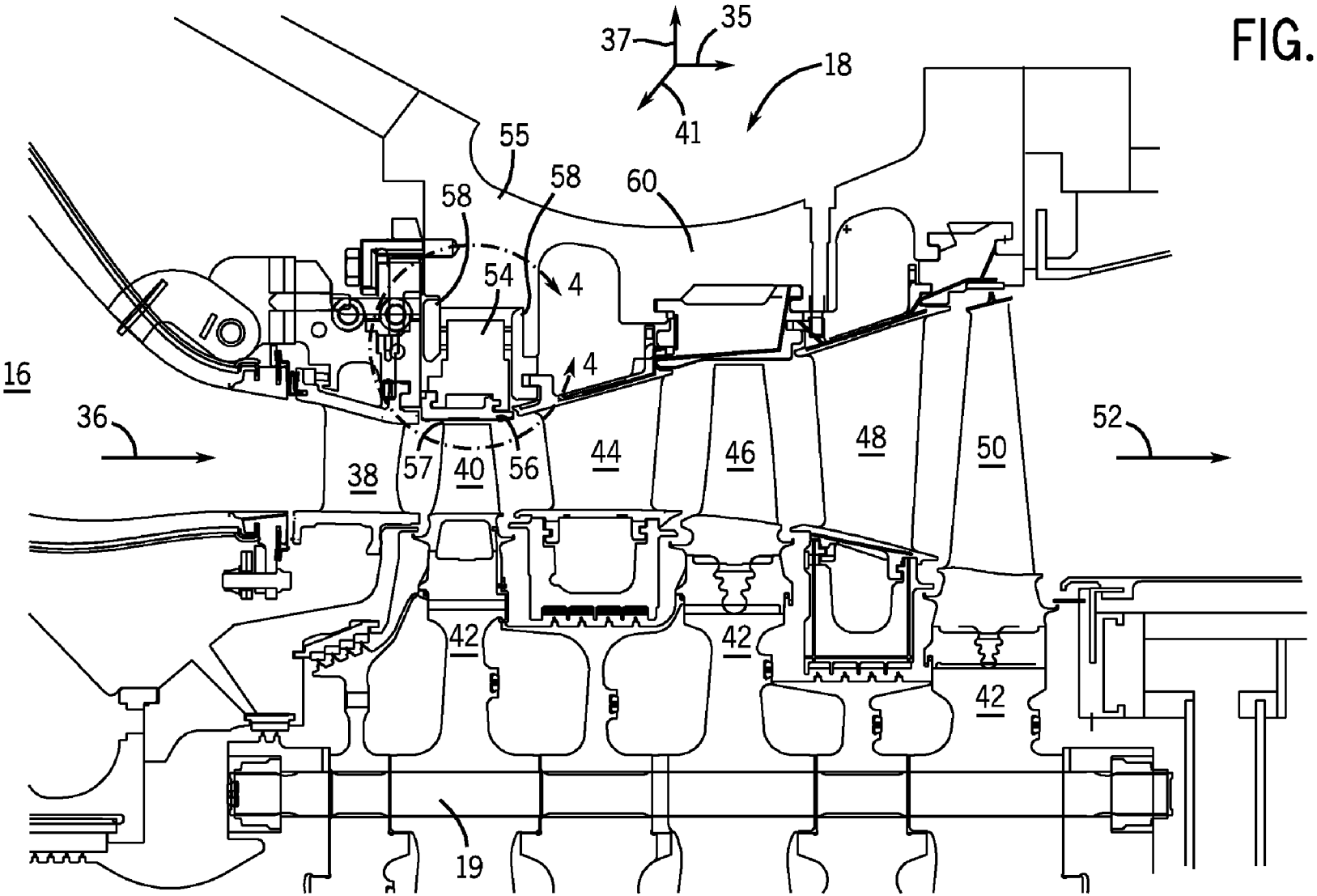
FIG. 3 is a cutaway side view of a turbine section taken within line 3-3 of FIG. 2 in accordance with certain embodiments of the present technique.

FIG. 3 is a detailed cross-sectional view of an embodiment of turbine 18 taken within line 3-3 of FIG. 2. Hot gas from the combustor 16 flows downstream into the turbine 18 in an axial direction 35, as illustrated by arrow 36. The turbine 18 illustrated in the present embodiment includes three turbine stages. Other turbine configurations may include more or fewer turbine stages. For example, a turbine may include between 1 and 20 turbine stages. The first turbine stage includes nozzles 38 and buckets (e.g., blades) 40 substantially equally spaced in a circumferential direction 41 about turbine 18. The first stage nozzles 38 are rigidly mounted to turbine 18 and configured to direct combustion gases toward the buckets 40. The first stage buckets 40 are mounted to a rotor 42 that rotates as combustion gases flow through the buckets 40. The rotor 42 is, in turn, coupled to the shaft 19 which drives compressor 22 and load 26. The combustion gases then flow through second stage nozzles 44 and second stage buckets 46. The second stage buckets 46 are also coupled to rotor 42. Finally, the combustion gases flow through third stage nozzles 48 and buckets 50. As the combustion gases flow through each stage, energy from the combustion gases is converted into rotational energy of the rotor 42. After passing through each turbine stage, the combustion gases exit the turbine 18 in the axial direction 35, as indicated by arrow 52.

As illustrated, first stage buckets 40 are surrounded by a turbine shroud 54, including a shroud liner 56. The shroud 54 is coupled to a turbine casing 55 by hangers 58 disposed around the circumference of the turbine 18. The shroud liner 56 of the present embodiment may be employed in turbines 18 that operate at high temperatures to thermally insulate the shroud 54. However, lower temperature turbines 18 may omit the shroud liner 56 if the shroud 54 is configured to withstand the operational temperatures.

The turbine shroud 54 may serve to minimize the quantity of combustion gases that bypass buckets 40. Specifically, a clearance or gap 57 between turbine shroud 54 and buckets 40 provides a path for combustion gases to bypass buckets 40 as the gases flow downstream along axial direction 35. Gas bypass is undesirable because energy from the bypassing gas is not captured by buckets 40 and translated into rotational energy. In other words, turbine system efficiency is at least partially dependent on the quantity of combustion gases captured by buckets 40. Therefore, minimizing the gap 57 between buckets 40 and shroud 54 is desirable. However, if the gap 57 is too small, the buckets 40 may contact the shroud 54 under certain operating temperatures, resulting in an undesirable condition known as rubbing. As appreciated, the radial length of gap 57 may change based on temperature. For example, during low temperature operating conditions, the gap 57 between the buckets 40 and the shroud 54 may be different than during periods of high temperature operation due to thermal expansion and contraction of the respective components. In certain embodiments, the operating temperature of turbine system 10 may range from approximately 500° C. to approximately 2000° C. The radial length of gap 57 may be particularly configured to prevent rubbing throughout the entire operating temperature range of the turbine system 10.

The present embodiment may minimize the radial length of gap 57 while reducing the possibility of rubbing between the turbine shroud 54 and the buckets 40. Specifically, as shown in FIG. 3, turbine shroud 54 is mounted to the turbine casing 55 with hangers 58 that facilitate motion of the shroud 54 in radial direction 37 with respect to the casing 55. Shroud 54 of the present embodiment may be composed of segments that join together to form an annular ring that surrounds buckets 40. Each of these segments may be individually supported by hangers 58 disposed to the turbine casing 55. Mounts between the hangers 58 and the segments of turbine shroud 54 may be configured to facilitate translation of shroud segments in radial direction 37 as temperature varies within turbine 18.

During turbine operation, the temperature of the shroud 54 and buckets 40 increases due to hot combustion gases flowing downstream along axial direction 35. However, the temperature of the turbine casing 55 may remain substantially lower than the temperature of the shroud 54 and buckets 40 due to its distance from the combustion gases as well as coolant circulation (e.g., air flow). As appreciated, higher temperatures typically cause components to expand. Therefore, by enabling the shroud 54 to translate in radial direction 37 relative to the turbine casing 55, the shroud 54 may expand as the buckets 40 elongate in radial direction 37. Consequently, a suitable gap 57 may be maintained throughout the entire operating temperature range of turbine 18. In contrast, if the shroud 54 were rigidly mounted to the turbine casing 55, shroud expansion may be inhibited by the turbine casing 55 which may experience a lower degree of expansion due to its cooler temperature. Therefore, to prevent rubbing, a larger gap 57 may be established between the buckets 40 and the shroud 54 to compensate for operating conditions in which the buckets 40 have elongated, but expansion of shroud 54 is limited due to the influence of the turbine casing 55. Hence, providing a mounting configuration that enables translation of turbine shroud segments in radial direction 37 with respect to the turbine casing 55 may facilitate a smaller gap 57, thereby increasing turbine efficiency.

As appreciated, in certain embodiments, an active control system may be used to move the shroud segments in the radial direction 37, adjust a temperature and thus radial expansion or contraction of the shroud segments via a coolant flow, or both, to vary the gap 57. During start-up or generally transient conditions, the gap 57 may be increased or maximized to reduce the possibility of a rub condition at the expense of a reduced efficiency. During steady state conditions (e.g., regular operation), the gap 57 may be decreased or minimized to provide an increased or maximum efficiency. As discussed below, the disclosed embodiments of the turbine shroud 54 improve the alignment and symmetry of the shroud 54 relative to turbine buckets 40, thereby enabling a tighter gap 57 for improved efficiency.

Figure 4:
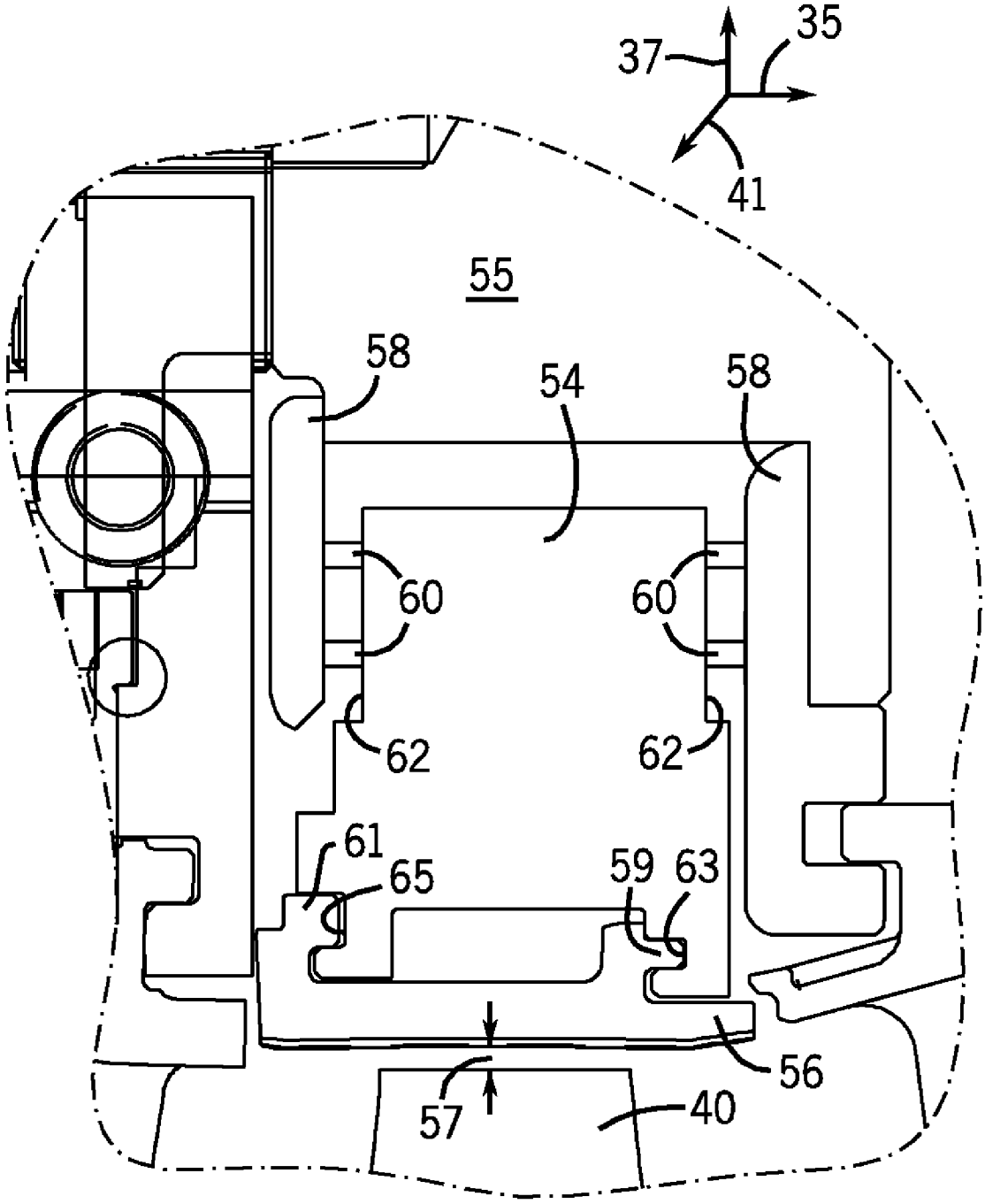
FIG. 4 is a cutaway side view of a shroud ring taken within line 4-4 of FIG. 3 in accordance with certain embodiments of the present technique.

FIG. 4 is a detailed view of an embodiment of turbine shroud 54 taken within line 4-4 of FIG. 3. The illustrated embodiment includes a shroud liner 56 that secures to shroud 54 via tabs or protrusions 59 and 61. Tabs 59 and 61 are configured to fit within grooves 63 and 65 of shroud 54, respectively. Tabs 59 and 61, and grooves 63 and 65 are configured to interlock to secure shroud liner 56 to shroud 54. In certain embodiments, the shroud liner 56 may be divided into multiple segments along circumferential direction 41. As previously discussed, shroud 54 may be composed of segments that interlock to surround turbine buckets 40. Each shroud segment may include one or more shroud liner segments. For example, each shroud segment may include 1, 2, 3, 4, 5 or more shroud liner segments. In this manner, shroud liner 56 may extend along the circumferential direction 41 in a full circle between shroud 54 and buckets 40. Alternatively, shroud liner 56 may be omitted such that shroud 54 is disposed directly adjacent to turbine buckets 40.

As previously discussed, shroud 54 is non-rigidly coupled to the turbine casing 55 by hangers 58. Specifically, pins 60 are oriented along axial direction 35 and coupled to hangers 58 to constrain movement of shroud 54 in axial direction 35 and circumferential direction 41. The pins 60 are rigidly mounted to hangers 58 and configured to slide within slots 62 of turbine shroud 54. For example, each shroud segment may include two slots 62 on each axial side (i.e., two slots 62 on an upstream side and two slots 62 on a downstream side). Two pins 60 may be disposed within each of these slots 62. In other words, a total of eight pins 60 may serve to align each segment of shroud 54 with the turbine casing 55. Alternative embodiments may employ more or fewer slots 62 and/or pins 60 within each slot. For example, in certain embodiments, each segment of turbine shroud 54 may include slots 62 on only one axial side. Further embodiments may employ 1, 2, 3, 4, 5, 6, 7, 8 or more slots per segment of shroud 54, on one or both axial sides. Yet further embodiments may utilize 1, 2, 3, 4, 5, 6 or more pins 60 per slot 62 to couple shroud 54 to the turbine casing 55. In other embodiments, alternative connectors such as tabs, tongues, or the like may be disposed within slots 62 to constrain movement of shroud 54 in axial direction 35 and circumferential direction 41.

As illustrated in FIG. 4, two pins 60 extend from each hanger 58 in axial direction 35. These pins fit within respective slots 62 oriented in radial direction 37. In this manner, shroud motion may be limited in axial direction 35 and circumferential direction 41. However, the pin and slot configuration may facilitate movement in radial direction 37. Therefore, shroud segments may translate radially inward during cooler turbine conditions and radially outward during warming turbine conditions. In this manner, the radial gap 57 between buckets 40 and shroud 54 may be maintained throughout the turbine operating temperature range.

Figure 5:
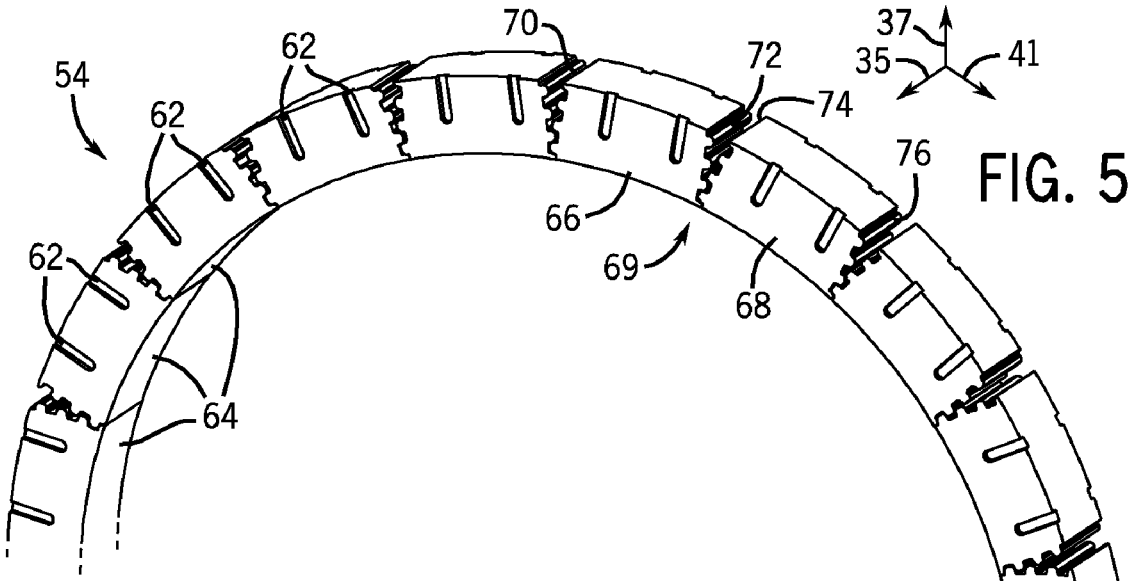
FIG. 5 is a perspective view of the shroud ring, as shown in FIG. 3, in accordance with certain embodiments of the present technique.

FIG. 5 is a perspective view of turbine shroud 54, including multiple shroud segments 64, in accordance with certain embodiments. The number of shroud segments 64 may vary based on turbine configuration. For example, the illustrated shroud 54 includes 20 shroud segments 64 arranged one after another in a circumferential arrangement to define a full circle. Alternative embodiments may include or exceed 2, 3, 4, 5, 6, 7, 8, 9, 10, 20, 30, 40, 50, or 60 segments, or any number of segments therebetween.

For example, the turbine shroud 54 includes adjacent shroud segments 66 and 68, among similarly arranged shroud segments 64, with an intermediate connection 69. As discussed in detail below, the intermediate connection 69 is configured to enable the shroud segments, e.g., 66 and 68, to translate in the radial direction 37 without restriction or undesirable deformation, while maintaining a constant seal between segments during thermal expansion and contraction. As a result, the intermediate connection 69 is able to maintain a suitable symmetry (e.g., circular shape) and alignment about the buckets 40, which also improves the uniformity of the gap 57 between the turbine shroud 54 and buckets 40. As illustrated, shroud segment 66 is positioned directly adjacent to shroud segment 68 along circumferential direction 41.

Each shroud segment includes a set of interlocking, or mating, teeth disposed along each circumferential side and oriented in axial direction 35. Specifically, shroud segment 66 includes a first set of teeth 70 on a first circumferential side and a second set of teeth 72 on a second circumferential side, opposite the first side. Similarly, shroud segment 68 includes a third set of teeth 74 disposed along a third circumferential side and a fourth set of teeth 76 disposed along a fourth circumferential side. As seen in FIG. 5, the second set of teeth 72 of segment 66 are interlocked with the third set of teeth 74 of segment 68. As described in detail below, the interlocking pattern of these teeth may vary with temperature of turbine shroud 54. Furthermore, additional turbine shroud segments 64 are positioned around the entire circumferential extent of turbine shroud 54. In this manner, combustion gases may be directed to flow through buckets 40, while minimizing bypass. Each shroud segment 64 includes similar sets of teeth to exemplary segments 66 and 68. These teeth are configured to interlock to form the turbine shroud 54 within the turbine casing 55. Specifically, the interlocking teeth support each segment 64 in the radial direction 37, while facilitating radial translation based on temperature variations within the turbine shroud 54.

As previously discussed, each shroud segment 64 includes two slots 62 on each axial side. These slots 62 are configured to interact with pins 60 to couple shroud 54 to the turbine casing 55. Specifically, pins 60 are disposed within each slot 62 to limit movement of each segment 64 in both axial direction 35 and circumferential direction 41. However, pins 60 enable translation of each segment 64 in radial direction 37. Therefore, as the interlocking engagement of the teeth varies with temperature, each segment 64 may freely translate in radial direction 37. This configuration may serve to maintain a substantially constant gap 57 between buckets 40 and shroud segments 64 throughout the operating temperature range of turbine 18, thereby increasing turbine system efficiency. Likewise, the intermediate connection 69 along with radial freedom of movement (e.g., via pins 60 and slots 62) enables the segments to maintain symmetry and alignment relative to the turbine buckets 40, which attributes to the improved control of the gap 57 throughout the operating temperature range of turbine 18.

Figure 6:
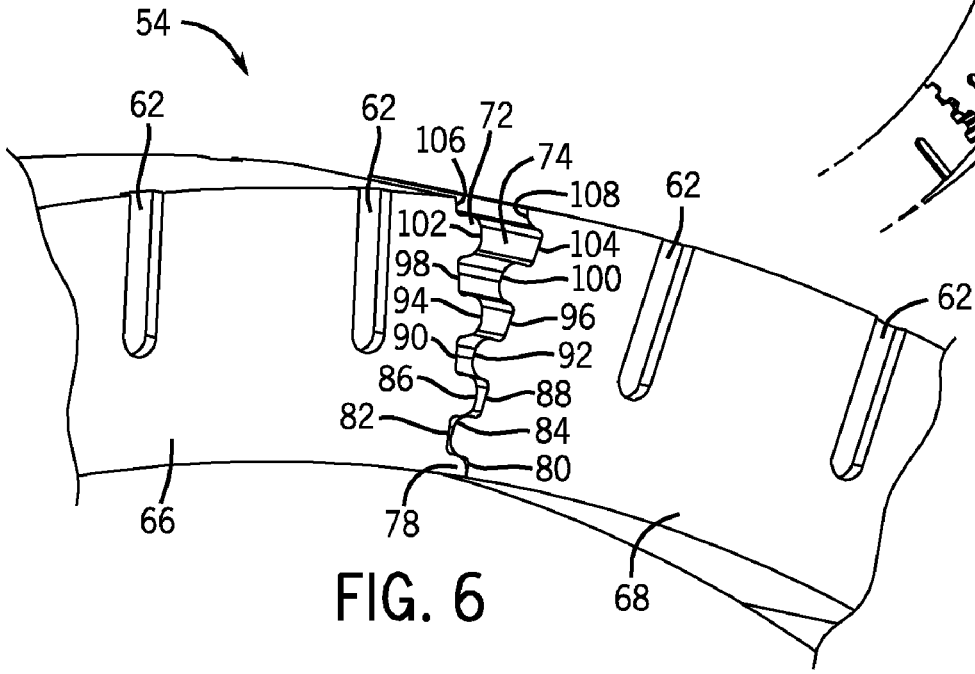
FIG. 6 is a perspective view of individual shroud ring segments, as shown in FIG. 5, during a period of high temperature turbine operation in accordance with certain embodiments of the present technique.

FIG. 6 is a detailed perspective view of exemplary shroud segments 66 and 68, showing each tooth of interlocking teeth 72 and 74, in accordance with certain embodiments. As previously discussed, these teeth 72 and 74 are oriented in axial direction 35, not radial direction 37 or circumferential direction 41. As illustrated, the teeth 72 and 74 are disposed one after another in the radial direction 37 relative to the longitudinal axis of the turbine engine. In addition, the teeth 72 and 74 are defined as a series of alternating male and female parts, which may be described as alternating tabs and slots, alternating tongues and grooves, or the like. In general, the male parts on one set of teeth 72 fit into the female parts on the other set of teeth 74, and vice versa. These alternating male and female parts also may be described as elongated in the axial direction 35, parallel to the axial direction 35, and parallel to one another. As illustrated, the tongues and grooves extend along the entire axial extent of the segments 64, from an upstream side to a downstream side. The number of tongues and grooves may vary based on the turbine system configuration. For example, teeth 72 and 74 may include 2, 3, 4, 5, 6, 7, 8 or more tongues and a corresponding number of grooves.

In the illustrated embodiment, each set of teeth, 72 and 74, includes four tongues and four grooves. Specifically, teeth 72 include tongues 78, 86, 94 and 102, and teeth 74 include tongues 84, 92, 100 and 108. Similarly, teeth 72 include grooves 82, 90, 98 and 106, and teeth 74 include grooves 80, 88, 96 and 104. These tongues and grooves are configured to interlock along axial direction 35 to support segments 66 and 68 of turbine shroud 54 in radial direction 37. In this configuration, tongue 78 is configured to interlock with groove 80, tongue 84 is configured to interlock with groove 82, tongue 86 is configured to interlock with groove 88, tongue 92 is configured to interlock with groove 90, tongue 94 is configured to interlock with groove 96, tongue 100 is configured to interlock with groove 98, tongue 102 is configured to interlock with groove 104, and tongue 108 is configured to interlock with groove 106. The teeth associated with the other segments 64 of shroud 54 are configured to interlock in a similar manner. This configuration of interlocking teeth 72 and 74 and mating pins 60 and slots 62 supports turbine shroud 54 in radial direction 37 while maintaining a substantially constant gap 57 between buckets 40 and shroud segments 64 throughout the operating temperature range of turbine 18. In addition, this configuration of interlocking teeth 72 and 74 and mating pins 60 and slots 62 also enables radial translation of the shroud segments 64 without undesirable deformation causing asymmetry or misalignment between the turbine shroud 54 and the buckets 40. Furthermore, this configuration of interlocking teeth 72 and 74 and mating pins 60 and slots 62 maintains a constant seal between the adjacent shroud segments 64, thereby improving turbine efficiency.

As seen in FIG. 6, the degree of overlap or engagement between each respective set of tongues and grooves varies along the radial extent of teeth 72 and 74. Specifically, tongue 78 is completely disposed or fully seated within groove 80 in the circumferential direction 41. Conversely, tongue 108 is completely separated from groove 106 in the circumferential direction 41. The separation distance between tongues and grooves therebetween increases in a radially outward direction. This configuration is consistent with a hot condition of shroud 54. As discussed in detail below, cooler shroud conditions result in a modified interlocking pattern. As previously discussed, each segment 64 may translate in radial direction 37 as the temperature of shroud 54 varies. This translation induces slots 62 to translate relative to pins 60 and alters the interlocking pattern of teeth 72 and 74. In this manner, the length of gap 57 between buckets 40 and shroud 54 may be maintained as temperature of the turbine 18 varies. Maintaining a substantially constant gap length enhances energy transfer from the combustion gases to the rotor, while reducing the probability of rubbing between buckets 40 and shroud 54.

Figure 7:
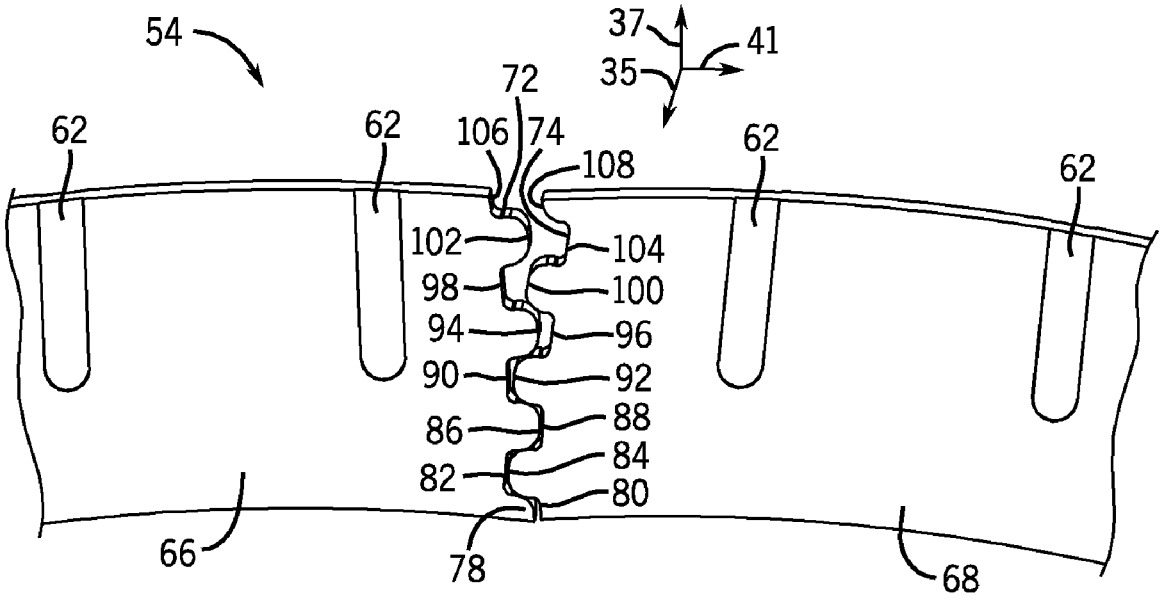
FIG. 7 is a perspective view of individual shroud ring segments, as shown in FIG. 5, during a period of low temperature turbine operation in accordance with certain embodiments of the present technique.

FIG. 7 is a perspective view of exemplary shroud segments 66 and 68 in a cold condition, in accordance with certain embodiments. As illustrated, the interlocking pattern between teeth 72 and 74 is different from the interlocking pattern described above with regard to the hot condition of FIG. 6. Specifically, tongues 78, 84 and 86 are completely disposed or fully seated within grooves 80, 82 and 88, respectively. Similarly, tongues 92, 94, 100, 102 and 108 are closer to grooves 90, 96, 98, 104 and 106, respectively, in the cold condition, as compared to the hot condition of FIG. 6. In general, the degree of interlock between teeth 72 and 74 in the cold condition is greater than the degree of interlock in the hot condition. The different interlocking pattern is due to thermal contraction of segments 66 and 68. As previously discussed, the thermal contraction of shroud segments 64 may induce the segments 64 to translate radially inward, i.e., closer to buckets 40. The degree of radially inward movement may be similar to the degree of radial contraction of buckets 40 during the cold operating condition. Therefore, the gap 57 between buckets 40 and shroud 54 may be maintained throughout the operating temperature range of turbine 18. Similarly, the radial movement of shroud segments 64 may enable shroud 54 to maintain its substantially circular shape despite turbine temperature variations. Maintaining symmetry and alignment of the shroud 54 may facilitate a tighter clearance during startup and/or transient conditions (e.g., cold operating conditions). As a result, energy transfer between the combustion gases and the turbine 18 may be substantially consistent through varying turbine temperatures, while reducing the probability of rubbing between buckets 40 and shroud 54.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine, comprising:

a rotor comprising a plurality of blades; and a shroud disposed about the plurality of blades, wherein the shroud comprises a plurality of segments engaged with one another via mating teeth, and the mating teeth are disposed one after another in a radial direction relative to a longitudinal axis of the turbine engine.

2. The system of claim 1, wherein the mating teeth support the plurality of segments in the radial direction.

3. The system of claim 1, wherein each tooth of the mating teeth is oriented in an axial direction along the longitudinal axis of the turbine engine, and each tooth extends an entire axial distance from an upstream side to a downstream side of the plurality of segments.

4. The system of claim 1, wherein the mating teeth are configured to engage one another at different radial positions in response to thermal expansion and contraction of the plurality of segments.

5. The system of claim 1, wherein the plurality of segments comprise slots along an upstream side, a downstream side, or both, and the slots extend in the radial direction.

6. The system of claim 5, wherein the turbine engine comprises pins disposed in the slots, the pins are oriented in an axial direction along the longitudinal axis of the turbine engine, and the slots are configured to translate relative to the pins to enable radial movement of the segments.

7. The system of claim 1, wherein the plurality of segments comprises a plurality of liner segments disposed between the plurality of segments and the blades.

8. The system of claim 7, wherein each of the plurality of segments comprises a plurality of the liner segments.

9. A system, comprising:

a turbine shroud comprising a plurality of segments disposed in a circumferential arrangement and configured to surround a plurality of turbine blades, wherein the turbine shroud comprises:

a first segment comprising a first set of teeth disposed on a first circumferential side and a second set of teeth disposed on a second circumferential side, wherein the teeth of the first and second sets are disposed one after another in a radial direction relative to an axis of the turbine shroud; and a second segment comprising a third set of teeth disposed on a third circumferential side and a fourth set of teeth disposed on a fourth circumferential side, wherein the teeth of the third and fourth sets are disposed one after another in the radial direction relative to the axis of the turbine shroud;

wherein the first and second segments couple together at the second and third sets of teeth, and the second and third sets of teeth support the first and second segments in the radial direction relative to the axis of the turbine shroud.

10. The system of claim 9, wherein the first, second, third, and fourth sets of teeth each comprise a series of parallel teeth oriented in an axial direction relative to the axis of the turbine shroud.

11. The system of claim 9, wherein the first, second, third, and fourth sets of teeth extend an entire axial distance from an upstream side to a downstream side of the plurality of segments.

12. The system of claim 9, wherein the second and third sets of teeth are configured to engage one another at different radial positions in response to thermal expansion and contraction of the plurality of segments.

13. The system of claim 9, wherein the plurality of segments comprise slots along an upstream side, a downstream side, or both, and the slots extend in the radial direction relative to the axis of the turbine shroud.

14. The system of claim 13, comprising a turbine engine comprising pins disposed in the slots, the pins are oriented in an axial direction relative to the axis of the turbine shroud, and the slots are configured to translate relative to the pins to enable radial movement of the plurality of segments.

15. The system of claim 9, wherein each segment comprises a plurality of liner segments disposed on an inner radial side of each segment.

16. A system, comprising:

a turbine casing;

a turbine shroud comprising a plurality of shroud segments configured to extend about a plurality of turbine blades; and a pin and slot guide disposed between the turbine casing and the plurality of shroud segments, wherein the pin and slot guide is configured to enable radial movement of the plurality of shroud segments relative to a rotational axis of a turbine engine.

17. The system of claim 16, wherein each shroud segment comprises slots disposed on upstream and downstream sides of the shroud segment relative to the rotational axis, and the slots are oriented in a radial direction relative to the rotational axis.

18. The system of claim 17, wherein the turbine casing comprises at least one fixed pin disposed in each slot, wherein each slot moves in the radial direction along each respective fixed pin.

19. The system of claim 16, wherein the plurality of shroud segments comprise mating teeth oriented in an axial direction along the rotational axis, and the mating teeth are configured to support the plurality of shroud segments in a radial direction relative to the rotational axis.

20. The system of claim 19, wherein the mating teeth are configured to engage one another at different radial positions in response to thermal expansion and contraction of the plurality of shroud segments.

* * * * *